US006767081B2

(12) United States Patent
Shirakawa et al.

(10) Patent No.: US 6,767,081 B2
(45) Date of Patent: Jul. 27, 2004

(54) THERMAL HEAD

(75) Inventors: Takashi Shirakawa, Iwate-ken (JP); Satoshi Kubo, Iwate-ken (JP); Masahisa Jumonji, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/303,206

(22) Filed: Nov. 25, 2002

(65) Prior Publication Data

US 2003/0103112 A1 Jun. 5, 2003

(30) Foreign Application Priority Data

Dec. 3, 2001 (JP) ..... 2001-368736
Dec. 20, 2001 (JP) ..... 2001-387468

(51) Int. Cl.[7] ..... B41J 2/05
(52) U.S. Cl. ..... 347/64
(58) Field of Search ..... 347/20, 56, 63, 347/64, 202, 205, 208

(56) References Cited

U.S. PATENT DOCUMENTS 5,661,513 A * 8/1997 Shirakawa et al. ..... 347/202

FOREIGN PATENT DOCUMENTS

JP 362111766 A * 5/1987 ..... B41J/3/20

* cited by examiner

*Primary Examiner*—Stephen D. Meler
*Assistant Examiner*—An H. Do
(74) *Attorney, Agent, or Firm*—Brinks Hofer Gilson & Lione

(57) ABSTRACT

A thermal head includes a heat insulating layer made up of an electrically-conductive multiple low oxide ceramic layer of low thermal conductivity made of a chemical compound of Si, plural transition metals and oxygen. A first insulating layer made up of an insulated multiple high nitride ceramic layer of low thermal conductivity made of a chemical compound of at least Si, plural transition metals and nitrogen is formed on the heat insulating layer, and a second insulating layer made up of an $SiO_2$ layer of high insulation characteristics or an $Al_2O_3$ layer is formed on the first insulating layer.

1 Claim, 4 Drawing Sheets

THERMAL HEAD

BACKGROUND OF THE INVENTION

1. Field of the Invention

The present invention relates to a thermal head for use with a thermal printer, and more particularly to a power-thrifty thermal head having high-speed thermal responsivity.

2. Description of the Related Art

In recent years, the thermal head has been heavily used for a recording device for various information apparatuses. Thus, in order to speed up, reduce the prices of, reduce power requirements of, and miniaturize these information apparatuses, a power-thrifty thermal head having high-speed thermal responsivity has also been requested.

In order to realize such a thermal head having high-speed thermal responsivity, for heat insulating layer material, material with thermal conductivity decreased can be used, and the thickness of the heat insulating layer can be made thinner to reduce the thermal capacity. However, it is technically difficult to decrease the thermal conductivity of a glaze heat insulating layer material which has conventionally been used, and when the glaze heat insulating layer is used, the thermal capacity of the glaze heat insulating layer has been decreased by simply forming to make the thickness thereof thinner, and the reserve heat has been reduced.

For this reason, high-speed printing has generally been performed with desired thermal responsivity while sacrificing savings in electric power.

With reference to FIG. 5, the description will be made of such a conventional thermal head. On the top surface of a substrate 1 with heat dissipating property, made of alumina or the like, there is formed a glaze heat insulating layer 2 made of glass, having thermal conductivity of nearly 1.1 W/m.k.

This glaze heat insulating layer 2 is formed so as to be as thick as, for example, 200 $\mu$m in thickness, and is formed with a projecting section 2*a* in which a portion formed with a heating element 3*a* to be described later protrudes at a predetermined height.

Also, on the top surface of the glaze heat insulating layer 2, there is formed a heating resistor 3 made of Ta—$SiO_2$, $TiO_2$ and the like, and on the top surface of this heating resistor 3, there are formed a common power feeding member 4 and an individual power feeding member 5. In a portion sandwiched between this common power feeding member 4 and the individual power feeding member 5, there is formed a heating element 3*a*.

On top of these components, a protective layer 6 made of ceramic such as Thialone is covered so as to prevent the heating element 3*a* or the common power feeding member 4, the individual power feeding member 5 and the like from being oxidized or worn.

In the conventional thermal head having such a structure, the individual power feeding member 5 is pulse-energized on the basis of printing information, whereby the heating element 3*a* is adapted to be able to selectively generate heat.

However, since such a conventional thermal head as described above has been only the glaze heat insulating layer 2 as extremely thick as, for example, 200 $\mu$m in thickness formed on top of the substrate 1 with heat dissipating property, it has the same thermal conductivity.

For the reason, the exothermic temperature due to single pulse energization while the glaze heat insulating layer 2 has been cool becomes a low exothermic temperature without regard to the thickness of the glaze heat insulating layer 2. Accordingly, since great applied energy is requested during energization, there has been the problem that at the head of line at the commencement of printing, no power saving effect has been obtained, and a peak current of the battery cannot be reduced.

Also, when pulse energization is continuously performed, reserve heat in a portion in which the heating element 3*a* with great printing duty has been formed in the glaze heat insulating layer 2 remarkably increases because of inferior heat dissipating property of the glaze heat insulating layer 2.

For the reason, the exothermic temperature of the heating element 3 becomes excessively high, and exceeds a control range of control of energized heat, which might possibly cause deteriorated printing quality due to blotting, tailing or the like on an image printed on a recording sheet.

However, in recent years, there has been disclosed a heat insulating layer material, of which power saving does not have to be sacrificed, and which is excellent in thermal responsivity. Such heat insulating layer material is obtained by forming low oxide ceramic with low thermal conductivity by means of oxygen reactive sputtering deposition.

With reference to FIG. 6, the description will be made of a conventional thermal head using such a heat insulating layer material as described above. On the surface of a substrate 11 excellent in heat dissipating property, made of silicon or the like, there is formed a projecting section 11*a* having a predetermined height by means of the photolithography technique, and on top of this projecting section 11*a*, a heat insulating layer 12 is stacked and formed.

The heat insulating layer 12 is made up of Si, plural transition metals and oxygen, has low thermal conductivity and electrical conductivity, having thermal conductivity of nearly 0.8 W/m.k and electrical resistivity of nearly 100 Ω-cm, and is formed to have a thickness of 10 to 30 $\mu$m on the substrate 11 by means of the oxygen reactive sputtering deposition.

Also, on the top surface of the heat insulating layer 12, in order to impart insulation characteristics and resistance to etching to the surface, an insulating layer 13 made of ceramic with insulation characteristics such as $SiO_2$ and $Al_2O_3$ is stacked and formed in a single layer at a thickness of nearly 2 $\mu$m by means of the sputtering deposition or the like.

Also, on the top surface of the insulating layer 13 as a single layer, a heating resistor 14 made of Ta—$SiO_2$, Ti—$SiO_2$ and the like is stacked by means of the sputtering deposition or the like, and a pattern of the heating resistor 14 is formed by means of the photolithography technique.

On the top surface of the heating resistor 14, a common power feeding member 15 and an individual power feeding member 16 which is made of Al, Cu and the like are formed, and a portion sandwiched between this common power feeding member 15 and the individual power feeding member 16 is formed with a heating element 14*a*.

On top of these components, a protective layer 17 made of ceramic such as Thialone is covered so as to prevent the heating element 14*a*, the common power feeding member 15, the individual power feeding member 16 and the like from being oxidized or worn.

Since there is formed a heat insulating layer 12 of low thermal conductivity on top of a silicon substrate 11 of high thermal conductivity, the conventional thermal head having such a structure is capable of obtaining high exothermic temperature at a heating element 14*a* due to single pulse energization to be singly driven, and decreasing printing blurring at the head of lines where the temperature of the substrate 11 is low at the commencement of printing.

Also, peak current of the power supply is decreased and it is possible to reduce power requirements and to miniaturize the power supply. Also, on account of a combination of the substrate 11 excellent in heat dissipating property with the heat insulating layer 12 with low thermal capacity excellent in heat insulating properties due to continuous pulse energization to be continuously driven, even in continuous energization, it is possible to gently raise the temperature at the substrate 11 due to reserve heat and to provide a thermal head excellent in high-speed printing with power requirements reduced.

However, such a conventional thermal head using the heat insulating layer material as described above has had the problem that even if, on top of the heat insulating layer 12 of electrical conductivity, the heating resistor 14 and the power feeding members 15 and 16 are stacked through the insulating layer 13 made of ceramic of insulation characteristics as a single layer, current leakage occurs between each pattern through the heat insulating layer 12 because of pin hole defects peculiar to vapor deposition.

When such current leakage occurs, the thermal head may not be able to be properly operated.

Also, even if the thickness of the insulating layer 13 was increased to nearly 2 $\mu$m, the leakage could not be completely eliminated. When the film thickness of the insulating layer 13 is further increased, since the insulating layer 13 had higher thermal conductivity than the heat insulating layer 12, there was the problem that thermal diffusion in the insulating layer 13 increased to deteriorate the thermal efficiency.

Further, in order to increase the thickness of the insulating layer 13 formed as a single-ply film to nearly 2 $\mu$m through the use of material such as $SiO_2$ and $Al_2O_3$ which is slow in sputtering speed, there was the problem that the production time becomes long and the productivity is deteriorated.

Also, as means for eliminating the pin hole defects peculiar to the vapor deposition, it is effective to divide and form as a film and to interpose a mechanical washing process therebetween, but there was the problem that the addition of such a washing process increased the number of man-hours required to fabricate the structure, thereby deteriorating the productivity.

SUMMARY OF THE INVENTION

The present invention has been achieved in views of such problems as described above, and is aimed to provide a thermal head suitable for high-speed printing with reduced power requirements, which eliminates leakage and prevents the thermal efficiency from being deteriorated due to thermal diffusion by forming plural layers of insulating layers of different materials on top of the heat insulating layer.

As first means for achieving the above-described object, there is provided a thermal head according to the present invention, including: a heat insulating layer formed on a top surface of a substrate; plural heating elements made up of plural heating resistors and power feeding members on the top surface of the heat insulating layer; and a protective layer for covering at least surfaces of the heating resistor and the power feeding member, wherein the structure is arranged such that the heat insulating layer is made up of an electrically-conductive multiple low oxide ceramic layer of low thermal conductivity made of a chemical compound of Si, plural transition metals and oxygen, and plural layers of insulating layers with different materials are formed on top of the heat insulating layer.

Also, as second means for achieving the above-described object, there is provided a thermal head according to the present invention, wherein the insulating layer is constructed such that a first insulating layer made up of an insulated multiple high nitride ceramic layer of low thermal conductivity which is a chemical compound of at least Si, plural transition metals and nitrogen, and on top of the first insulating layer, a second insulating layer made up of a $SiO_2$ layer of high insulation characteristics or an $Al_2O_3$ layer are stacked and formed.

Further, as third means for achieving the above-described object, there is provided a thermal head according to the present invention, including: a heat insulating layer formed on a top surface of a substrate; plural heating elements formed of plural heating resistors and power feeding members on the top surface of the heat insulating layer; and a protective layer for covering at least surfaces of the heating resistors and the power feeding members, wherein the structure is arranged such that the substrate is made of glass whose composition is phase-separated by means of heat treatment and caused to protrude at a predetermine height at a position where the heating element is formed to form a projecting section; and the heat insulating layer is made into a two-layer structure of: a first heat insulating layer made up of a porous glass layer obtained by selectively eluting one composition of the glass whose phase is separated, which is partially formed on the projecting section; and a second heat insulating layer made of ceramic of low thermal conductivity stacked and formed on the first heat insulating layer.

Further, as fourth means for achieving the above-described object, there is provided a thermal head according to the present invention, wherein the structure is arranged such that there is formed a mask layer for covering the top surface of the substrate including the projecting section, wherein the mask layer is formed with an opening for partially forming the first heat insulating layer at an apex of the projecting section, and wherein the apex of the projecting section is exposed from this opening.

Further, as fifth means for achieving the above-described object, there is provided a thermal head according to the present invention, wherein the structure is arranged such that the mask layer is made of ceramic of insulation characteristics having a thickness of 0.01 to 0.1 $\mu$m, that the first heat insulating layer is partially formed from the opening, and that the second heat insulating layer is formed on the top surfaces of the first heat insulating layer and the mask layer.

Further, as sixth means for achieving the above-described object, there is provided a thermal head according to the present invention, wherein the structure is arranged such that the first heat insulating layer is made up of a porous silicon layer of high heat insulating properties, having thermal conductivity of 0.3 to 0.5 W/m.k.

Further, as seventh means for achieving the above-described object, there is provided a thermal head according to the present invention, wherein the structure is arranged such that the second heat insulating layer is made up of a ceramic layer of low thermal conductivity having thermal conductivity of 0.8 to 1.0 W/m.k, made of a chemical compound of Si, plural transition metals and oxygen.

Further, as eighth means for achieving the above-described object, there is provided a thermal head according to the present invention, wherein the second heat insulating layer is constructed to become flat by eliminating a difference in level corresponding to a thickness of the mask layer which is caused by following a shape of the opening.

Further, as ninth means for achieving the above-described object, there is provided a thermal head according to the present invention, wherein the second heat insulating layer is constructed by stacking at a thickness of 10 to 30 $\mu$m on top of the first heat insulating layer.

DETAILED DESCRIPTION OF THE PREFERRED EMBODIMENTS

Hereinafter, with reference to the drawings, the description will be made of the thermal head according to the present invention.

Figure 1:
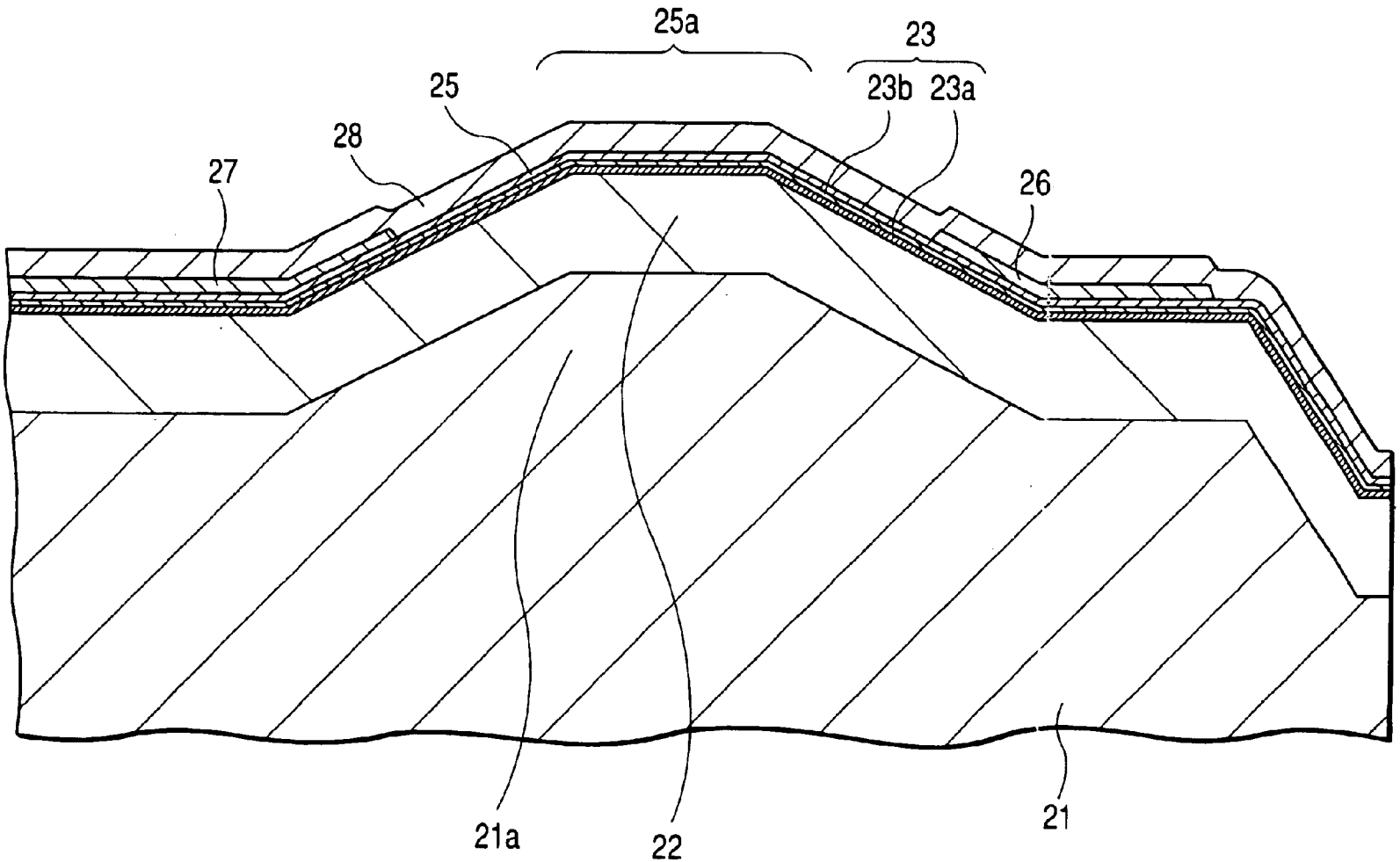
FIG. 1 is a cross sectional view showing a principal part of a thermal head according to a first embodiment of the present invention.
Figure 2:
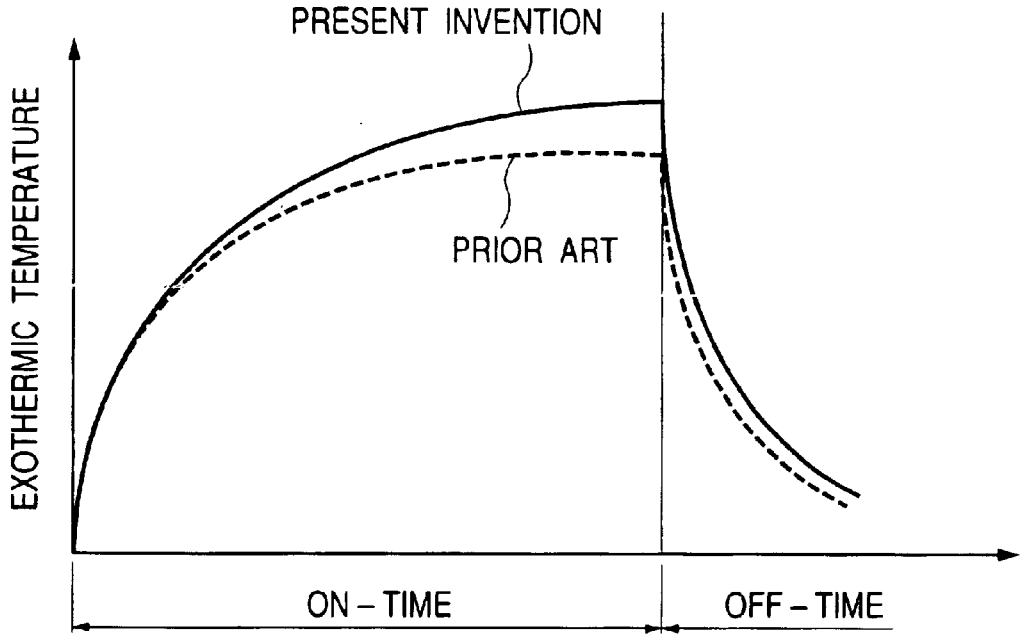
FIG. 2 is a graph for explaining heat insulation characteristics concerning the thermal head according to the first embodiment of the present invention.

FIG. 1 is a cross sectional view showing a principal part of a thermal head according to a first embodiment of the present invention, and FIG. 2 is a graph showing comparisons in thermal responsivity between the thermal head according to the first embodiment of the present invention and the conventional thermal head.

First, the thermal head according to the first embodiment of the present invention is, as shown in FIG. 1, formed with a projecting section 21*a*, whose cross section is shaped substantially like a trapezoid, smoothly protruding at height of 2 to 20 $\mu$m on the surface of a substrate 21 made of silicon or the like, excellent in heat dissipation property.

On the top surface of the substrate 21, there is formed a black, low-density heat insulating layer 22 having electrical conductivity including metal, excellent in mechanical strength and heat insulation properties.

This heat insulating layer 22 has as low thermal conductivity as nearly 0.8 W/m.k, is made up of plural transition metals and oxygen, and stacked at a thickness of 10 to 30 $\mu$m for forming by means of the oxygen reactive sputtering deposition. Also, the heat insulating layer 22 is formed as a film to have electrical conductivity with electrical resistivity of nearly 100 Ω-cm.

Further, on the top surface of the heat insulating layer 22, there are formed plural layers of insulating layers 23 with different materials. These insulating layers 23 have, in the lower layer, a first insulating layer 23*a*, formed, made of low thermally-conductive insulating multiple high nitride ceramic with a thickness of 0.2 to 1.0 $\mu$m with Si of the main material as $Si_3N_4$ of high insulation characteristics.

Also, in the upper layer, there is stacked a second insulating layer 23*b* made up of a high insulating $SiO_2$ layer or an $Al_2O_3$ layer with a thickness of nearly 0.3 $\mu$m, and plural layers of insulating layer 23 is formed. In other words, the insulating layer 23 is obtained by stacking at least the first and second insulating layers 23*a* and 23*b* for forming.

Also, on top of the second insulating layer 23*b*, a pattern of the heating resistor 25 made of Ta—$SiO_2$ and the like is stacked at a thickness of nearly 0.1 $\mu$m.

On top of the heating resistor 25, there are formed a common power feeding member 26 and an individual power feeding member 27 which are made of Al, Cu and the like, and a heating element 25*a* is formed in a portion sandwiched between the common power feeding member 26 and the individual power feeding member 27.

Also, in order to prevent at least the heating resistor 25, the common power feeding member 26 and the individual power feeding member 27 from being oxidized and worn, on top of these components, a protective layer 28 made of ceramic such as Thialone is stacked and covered at a thickness of nearly 5 $\mu$m.

The description will be made of a manufacturing method for a thermal head having such structure according to the present invention.

First, on the surface of a substrate 21 with high heat dissipating property, a projecting section 21*a* with a height of 2 to 20 $\mu$m is projectingly formed by means of the photolithography technique.

Next, on the top surface of the substrate 21, a black heat insulating layer 22 is formed by means of the oxygen reactive sputtering deposition. In other words, the heat insulating layer 22 is obtained by sputter-depositing a black, low-density low oxide ceramic film with the degree of oxidization controlled and which has very low thermal conductivity.

After the completion of the oxygen reactive sputter deposition of the heat insulation layer 22, the oxygen gas is replaced with nitrogen gas within the same apparatus while the vacuum within the apparatus is maintained to perform the nitrogen reactive sputter deposition in a high nitrogen atmosphere for continuously forming a first insulating layer 23*a* made of insulating multiple high nitride ceramic with low thermal conductivity.

On top of this first insulating layer 23*a*, there is stacked and formed a second insulating layer 23*b* made of an $SiO_2$ layer with high insulation characteristics or an $Al_2O_3$ layer by means of the sputter deposition.

This second insulating layer 23*b* may be formed after the protrusion defect on the surface is removed by polishing the surface of the first insulating layer 23*a* after the formation of the first insulating layer 23*a*. On the surface of the first insulating layer 23*a* thus polished, the second insulating layer 23*a* is formed, whereby it is possible to securely eliminate the leakage.

Next, on top of the second insulating layer 23*b*, the heating resistor 25 is stacked and formed by means of the sputter deposition to form a pattern of the heating resistor 25 by means of the photolithography technique.

Next, on top of the heating resistor 25, the power feeding member material is stacked by means of the sputter deposition to form the common power feeding member 26 and the individual power feeding member 27.

Next, on top of at least the heating resistor 25, the common power feeding member 26 and the individual power feeding member 27, the protective layer 28 is stacked and covered by means of the sputter deposition.

Since the first insulating layer 23*a* is formed in continuation of the film formation of the heat insulating layer 22, the above-described thermal head according to the present invention is capable of enhancing the reliability of the insulation characteristics even if, on top of the first insulating layer 23*a*, the second insulating layer 23*b* made of $SiO_2$ or $Al_2O_3$ is stacked and formed as thin as a thickness of nearly 0.3 μm.

Also, a second insulating layer 23*b* having thermal conductivity higher than the heat insulating layer 22 is formed and is thin in film thickness thereof, whereby the thermal head according to the first embodiment of the present invention is capable of preventing the thermal efficiency from being deteriorated due to thermal diffusion.

For that reason, as shown in the graph of thermal responsivity of FIG. 2, the thermal head according to the present invention indicated by a solid line is capable of raising the exothermic temperature per unit time higher than the thermal head according to the related art indicated by a broken line, and is more suitable for high-speed printing with power requirements reduced.

As described above, since plural layers of insulating layers with different materials have been formed on top of the heat insulating layer made up of an electrically-conductive multiple low oxide ceramic layer of low thermal conductivity made of a chemical compound of Si, plural transition metals and oxygen, the thermal head according to the first embodiment of the present invention is capable of eliminating the pin hole defect peculiar to vapor deposition, and eliminating current leakage.

Also, since the insulating layer has been formed by stacking a first insulating layer made up of an insulated multiple high nitride ceramic, layer of low thermal conductivity made of a chemical compound of at least Si, plural transition metals and nitrogen, and on top of this first insulating layer, a second insulating layer made up of a $SiO_2$ layer of high insulating properties or an $Al_2O_3$ layer, the first embodiment of the present invention is capable of providing the thermal head excellent in high-speed thermal responsivity with power requirements reduced by eliminating the current leakage.

Figure 3:
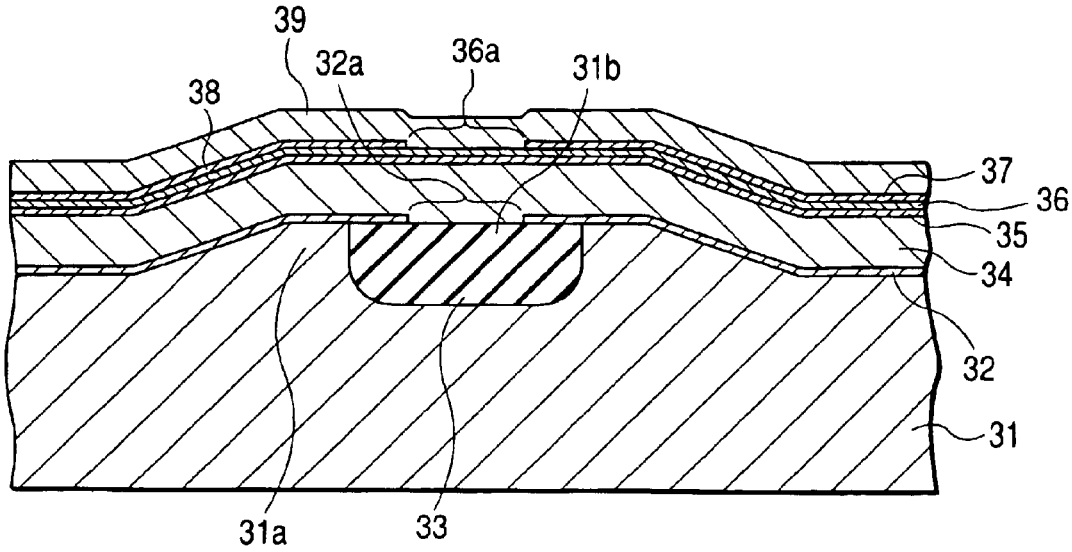
FIG. 3 is a cross sectional view showing a principal part of a thermal head according to a second embodiment of the present invention.
Figure 4:
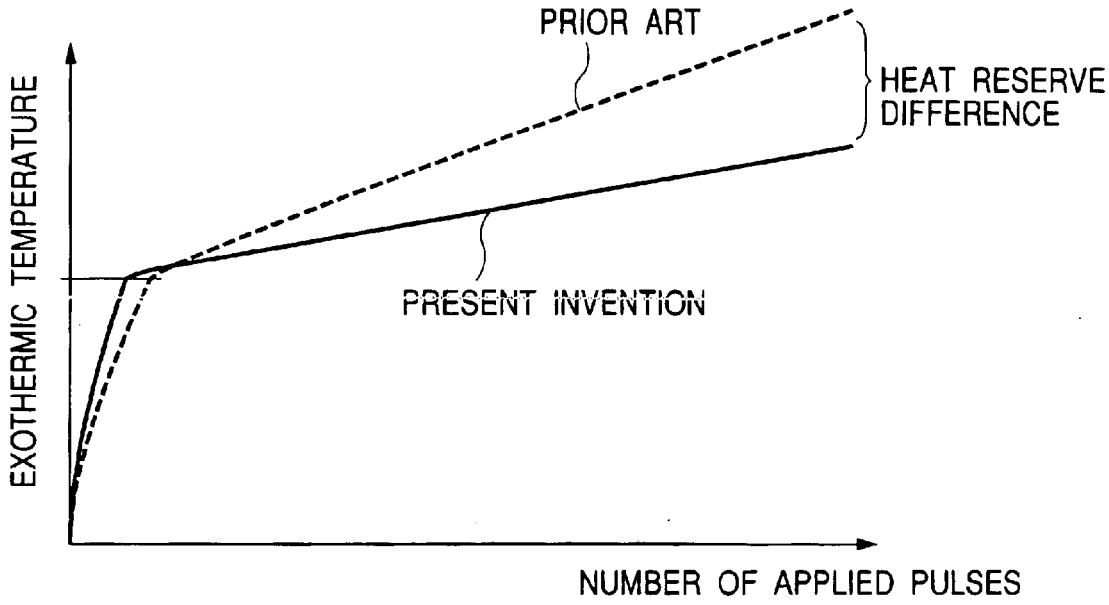
FIG. 4 is a graph for explaining heat insulation characteristics concerning the thermal head according to the second embodiment of the present invention.
Figure 5:
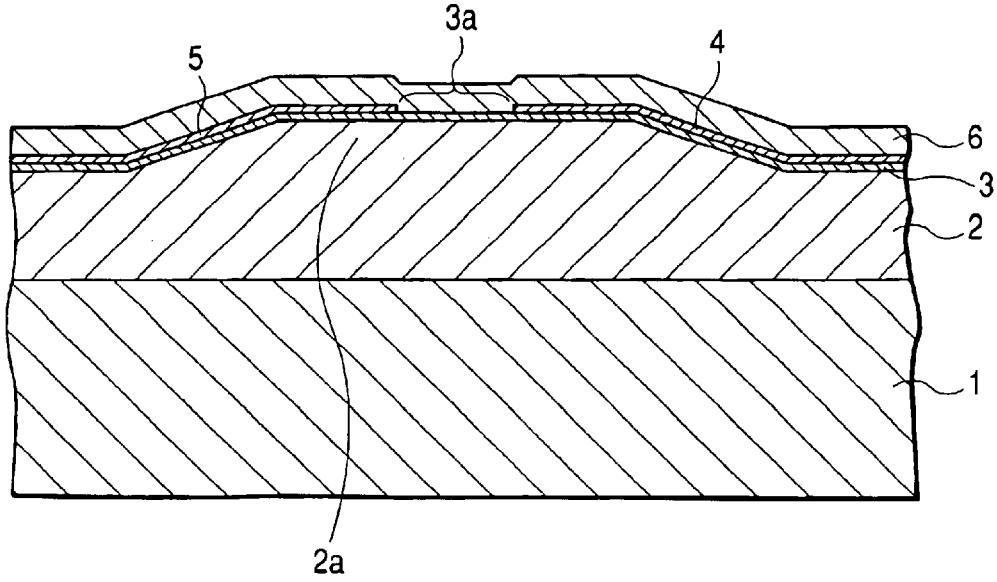
FIG. 5 PRIOR ART
FIG. 5 is a cross sectional view showing a principal part of a first example of a conventional thermal head.
Figure 6:
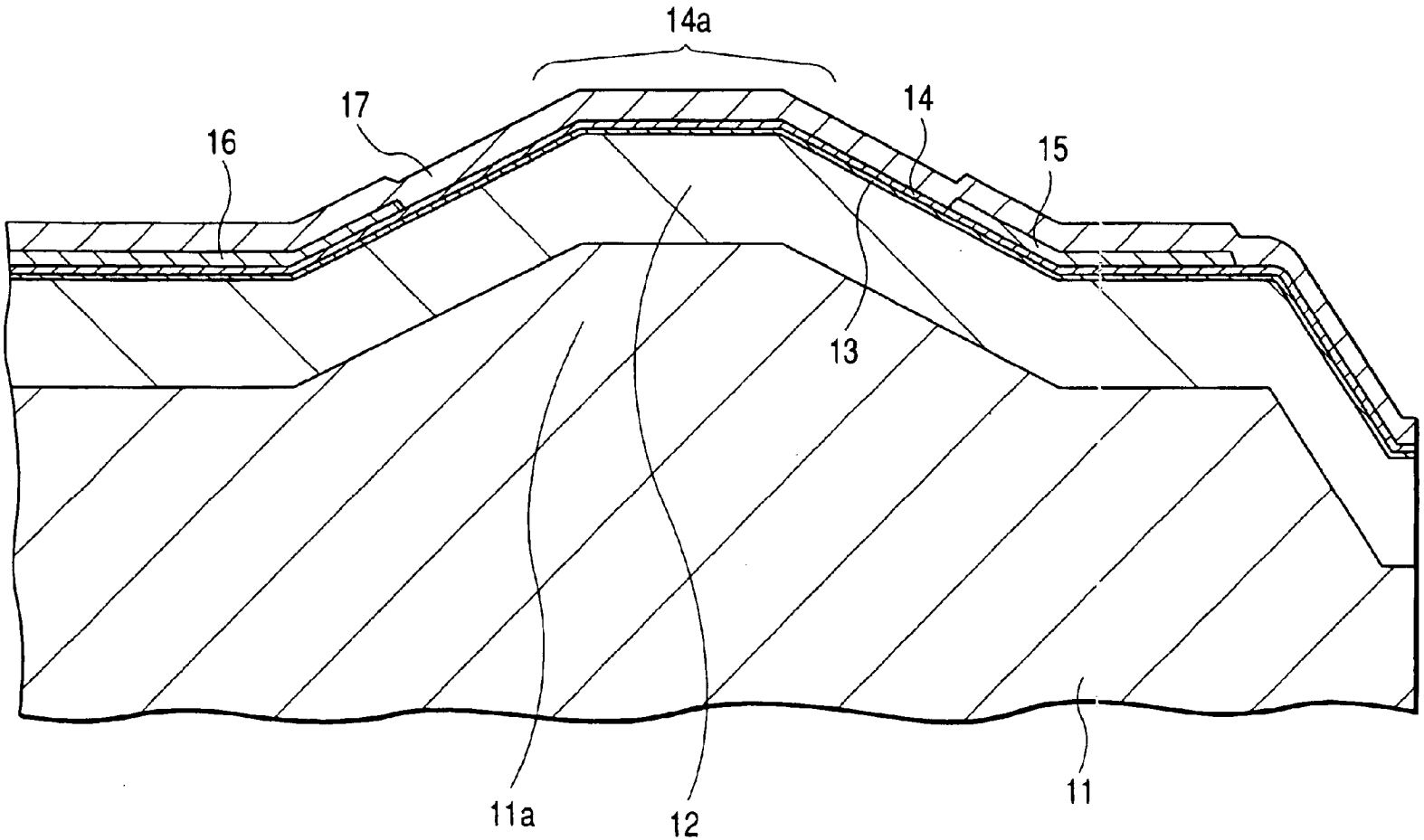
FIG. 6 PRIOR ART
FIG. 6 is a cross sectional view showing a principal part of a second example of the conventional thermal head.

Next, with reference to the drawing, the description will be made of the thermal head according to the second embodiment of the present invention. FIG. 3 is a cross sectional view showing a principal part according to the present invention, and FIG. 4 is a graph for explaining comparison in thermal efficiency between the thermal head according to the second embodiment of the present invention and the conventional thermal head.

First, the thermal head according to the second embodiment of the present invention has, as shown in FIG. 3, used a substrate 31 made of glass with a thickness of nearly 1 mm. This substrate 31 has higher thermal diffusivity than the glaze heat insulating layer 2 described in the Related art, and is made of glass whose composition is easy to be phase-separated by heat treatment.

On the surface of this substrate 31, there is formed a projecting section 31*a*, whose cross section protrudes substantially like a trapezoid, with a height of 2 to 50 μm by etching based on the photolithography technique or the like. Thus, after the formation of the projecting section 31*a*, the substrate 31 is heat-treated at a temperature of 500 to 600° C. to phase-separate the composition of the glass.

Further, after the substrate 31 is subjected to a phase separation heat treatment, on the surface of the substrate 31, $SiO_2$ and the like are stacked at a thickness of 0.01 to 0.1 μm to form a mask layer 32 for covering the top surface of the substrate 31 including the projecting section 31*a* by means of the photolithography technique.

In this mask layer 32, on the apex 31*b* of the projecting section 31*a*, there is formed a slit-shaped opening 32*a* with a width of nearly 50 μm, and from this opening 32*a*, a portion of the apex 31*b* of the projecting section 31*a* is exposed.

In this respect, the projecting section 31*a* and the mask layer 32 may be formed before the substrate 31 is subjected to the phase separation heat treatment, and thereafter, may be subjected to the phase separation heat treatment.

Further, the substrate 31 formed with the mask layer 32 is immersed in heated acid liquid such as hydrochloric acid or nitric acid or thermal water, whereby there is formed a first heat insulating layer 33 made up of a porous glass layer in which a glass phase such as Na2O-B2O3 has been selectively eluted on the apex 31*b* of the projecting section 31*a* exposed from the opening 32*a*.

The first heat insulating layer 33 has remarkably lower thermal conductivity than the glaze heat insulating layer 2 described in the Related art, and its thermal conductivity is 0.3 to 0.5 W/m.k. In this respect, the first heat insulating layer 33 has a depth of nearly 50 μm, and is formed directly below a heating element 36*a* to be described later.

Also, on the top surfaces of the first heat insulating layer 33 and the mask layer 32 which are exposed from the opening 32*a*, there is formed a second heat insulating layer 34 made of ceramic with low thermal conductivity, and excellent in mechanical strength and heat insulating properties.

Thus, this second heat insulating layer 34 has been stacked and formed at a thickness of 10 to 30 μm by means of the sputter deposition, and also serves to reinforce the first heat insulating layer 33, which is porous and inferior in mechanical strength.

In this respect, the second heat insulating layer 34 is made up of Si, plural transition metals and oxygen, and has thermal conductivity of 0.8 to 1.0 W/m.k.

Also, on the surface of the second heat insulating layer 34, in order to eliminate a difference in level (not shown) corresponding to the thickness of the mask layer 32 which is caused by following the shape of the opening 32*a* of the mask layer 32, the top surface of the second heat insulating layer 34 is made flat by polishing.

Also, on the top surface of the second heat insulating layer 34 which has been made flat by polishing, an undercoat layer 35 made of ceramic with insulation characteristics such as $SiO_2$ having resistance to etching has been stacked and formed at a thickness of nearly 0.3 μm.

On top of this undercoat layer 35, a heating resistor 36 made of Ta—$SiO_2$ has been stacked at a thickness of nearly 0.1 μm by means of the sputter deposition, and a pattern of the heating resistor has been formed by means of the photolithography technique.

Further, on top of the heating resistor 36, power feeding member material made of Al, Cu and the like is stacked at a thickness of 1 to 3 μm by means of the sputter deposition, and a common power feeding member 37 and an individual power feeding member 38 have been formed by means of the photolithography technique. In this respect, a portion sandwiched between the common power feeding member 37 and the individual power feeding member 38 is a heating element 36*a*.

This heating element 36*a* is formed at such a position as the first heat insulating layer 33 comes directly below the heating element 36*a*.

Thus, in order to prevent at least the heating resistor 36, the common power feeding member 37 and the individual power feeding member 38 from being oxidized or worn, on top of these components, a protective layer 39 made of ceramic such as Thialone is stacked and covered at a thickness of nearly 5 $\mu$m by means of the sputter deposition.

As described above, the thermal head according to the second embodiment of the present invention has been formed by stacking a first heat insulating layer 33 made up of a porous $SiO_2$ layer with high heat insulating properties having thermal conductivity of 0.3 to 0.5 W/m.k, and on top of this first heat insulating layer 33, a second heat insulating layer 34 with low thermal conductivity of 0.8 to 1.0 W/m.k. Therefore, since this thermal head has remarkably higher heat insulating properties than the conventional glaze heat insulating layer 2, a heat flow generated in the heating element 36*a* receives high heat resistance of the first and second heat insulating layers 33 and 34 to decrease an amount of heat into the substrate 31.

Thus, since the reaction increases the amount of heat on the print medium (not shown) side with which the heating element 36*a* is brought into press contact, the thermal head can be used as a power-thrifty thermal head with high thermal efficiency which is optimum particularly for use with a portable printer and the like to be battery driven.

In such a thermal head according to the second embodiment of the present invention, although the substrate 31 is a glass substrate having low thermal diffusivity, due to an operation of the first and second heat insulating layers 33 and 34 with high heat insulating properties which have been formed in two layers, a temperature rise in the thermal head according to the second embodiment of the present invention indicated by a solid line becomes gentler than the thermal head according to the related art indicated by a broken line as shown in FIG. 4 even if printing is made continuously, and a time period until blotting or tailing failure due to excessive printing density occurs, can be extended. For that reason, a number of times of stoppage for cooling during printing also becomes less, and it is possible to reduce a decline in the throughput which is effective printing speed.

As described above, the thermal head according to the second embodiment of the present invention has been made into a two-layer structure of: a first heat insulating layer made up of a porous glass layer obtained by selectively eluting one composition of the glass whose phase has been separated, which has been partially formed on the projecting section; and a second heat insulating layer made of ceramic with low thermal conductivity stacked and formed on this first heat insulating layer. Therefore, it is possible to provide a power-thrifty thermal head with high thermal efficiency, which is excellent in mechanical strength and optimum for use with a portable printer or the like.

Further, there is formed a mask layer for covering the top surface of the substrate including the projecting section, in this mask layer, there is formed an opening for partially forming the first heat insulating layer at the apex of the projecting section, and the apex of the projecting section is exposed from this opening. Therefore, the substrate formed with the mask layer is immersed in acid liquid or thermal water, whereby it is possible to easily form a first heat insulating layer made up of a porous glass layer on the apex of the projecting section exposed from the opening, and to provide a power-thrifty thermal head easy to be manufactured.

Further, since the first heat insulating layer is made up of a porous silicon layer with high heat insulating properties, having thermal conductivity of 0.3 to 0.5 W/m.k, a thermal head with high thermal efficiency can be provided.

Further, since the mask layer is made of ceramic with insulation characteristics having a thickness of 0.01 to 0.1 $\mu$m, the first heat insulating layer is partially formed from the opening, and on the top surfaces of this first heat insulating layer and the mask layer, there is formed the second heat insulating layer, it is easy to manufacture the second heat insulating layer which also serves as a reinforcement layer for the first heat insulating layer.

Further, since the second heat insulating layer is made up of a ceramic layer with low thermal conductivity having thermal conductivity of 0.8 to 1.0 W/m.k, made of a chemical compound of Si, plural transition metals and oxygen, this second heat insulating layer and the first heat insulating layer are made into a two-layer structure, whereby it is possible to provide a thermal head with high thermal efficiency, excellent in mechanical strength.

Further, since the second heat insulating layer has been made flat by eliminating a difference in level corresponding to the thickness of the mask layer which is caused by following the shape of the opening, it is possible to securely bring the heating element portion on the opening into tight contact with the recording medium or the like, and to provide a thermal head capable of printing in high quality.

Further, since the second heat insulating layer has been formed by stacking at thickness of 10 to 30 $\mu$m on top of the first heat insulating layer, it is possible to increase the mechanical strength of the second heat insulating layer, to securely reinforce the first heat insulating layer, which is inferior in mechanical strength, and to improve the long lasting characteristics and the like.

What is claimed is:

1. A thermal head comprising:

a heat insulating layer formed on a top surface of a substrate;

a first insulating layer and a second insulating layer formed on top of the heat insulating layer, the first insulating layer containing an insulated multiple high nitride ceramic layer of low thermal conductivity comprising $Si_3N_4$ and the second insulating layer formed on top of the first insulating layer containing an $SiO_2$ layer of high insulation characteristics or an $Al_2O_3$ layer;

plural heating elements containing plural heating resistors and power feeding members formed on the heat insulating layer, the heating resistors formed on the second insulating layer; and a protective layer that covers at least surfaces of the heating resistors and the power feeding members, wherein the heat insulating layer contains of-an electrically-conductive multiple low oxide ceramic layer with low thermal conductivity that includes a chemical compound of Si, plural transition metals and oxygen.

* * * * *

UNITED STATES PATENT AND TRADEMARK OFFICE

CERTIFICATE OF CORRECTION

PATENT NO. : 6,767,081 B2
DATED : July 27, 2004
INVENTOR(S) : Takashi Shirakawa et al.

It is certified that error appears in the above-identified patent and that said Letters Patent is hereby corrected as shown below:

Title page,
*Primary Examiner*, delete “Meler” and substitute -- Meier -- in its place.

Column 10,
Line 56, after “contains” delete “of-an” and substitute -- an -- in its place.

Signed and Sealed this

Twenty-second Day of February, 2005

JON W. DUDAS
*Director of the United States Patent and Trademark Office*